United States Patent [19]

Johnson

[11] 4,185,847

[45] Jan. 29, 1980

[54] SKATEBOARD TRUCK WITH INDEPENDENT WHEEL SUSPENSION

[76] Inventor: Robert D. Johnson, 7882 Cedar Lake Ave., San Diego, Calif. 92119

[21] Appl. No.: 844,973

[22] Filed: Oct. 25, 1977

[51] Int. Cl.[2] ..... A63C 17/02

[52] U.S. Cl. ..... 280/87.04 A; 280/11.28

[58] Field of Search ..... 280/87.04 A, 11.28, 280/11.27, 11.26, 11.19, 11.1 BT

[56] References Cited

U.S. PATENT DOCUMENTS

| | | | |
|---|---|---|---|
| 304,949 | 9/1884 | Mitchell | 280/11.28 X |
| 2,079,185 | 5/1937 | Schmidt | 280/11.28 |
| 4,062,557 | 12/1977 | Roden | 280/87.04 A |

*Primary Examiner*—Joseph F. Peters, Jr.

*Assistant Examiner*—Milton L. Smith

*Attorney, Agent, or Firm*—Flehr, Hohbach, Test, Albritton & Herbert

[57] ABSTRACT

A skateboard is provided with trucks, each of which carries a plurality of wheels mounted in independent suspension. Longitudinally extending arms carry the wheel axles forwardly or rearwardly relative to a mounting which secures the arms in rotatable fashion to the trucks. The arms are resiliently biased by means of separate springs or torsion bars so that varying pressures across the skateboard platform alter the distance of the skateboard wheels from the underside of the platform and conversely roadway irregularities displace the skateboard wheels towards the platform independently one from another.

11 Claims, 17 Drawing Figures

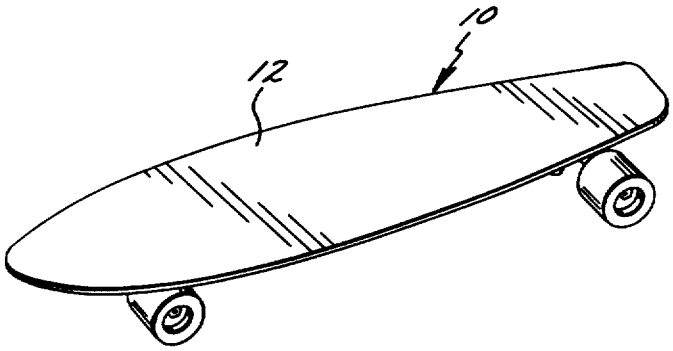
FIG. 1
FIG. 2
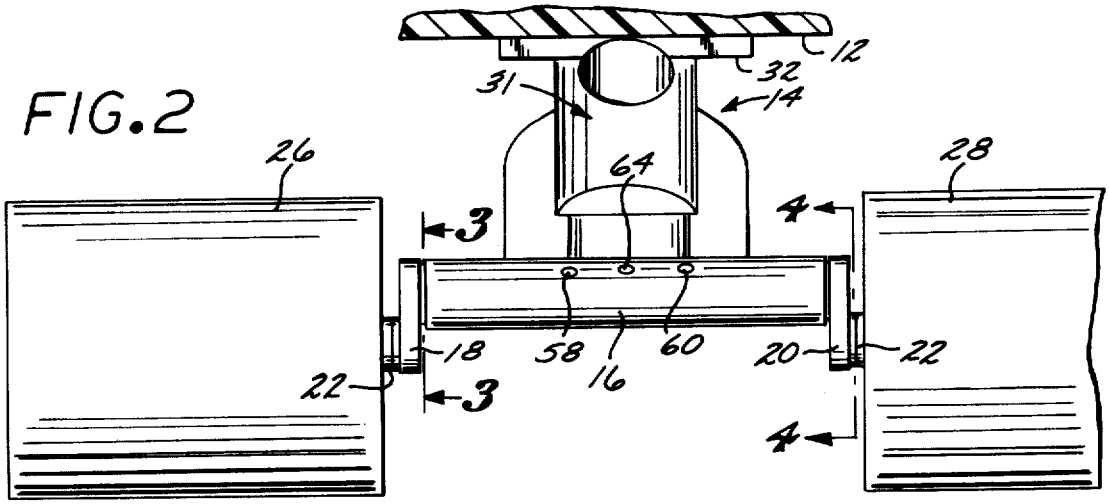
FIG. 3
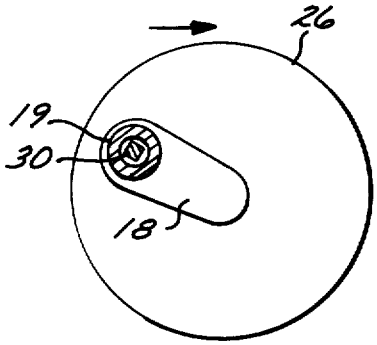
FIG. 4
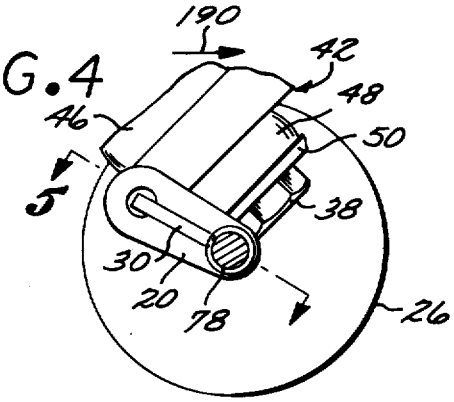
FIG. 5
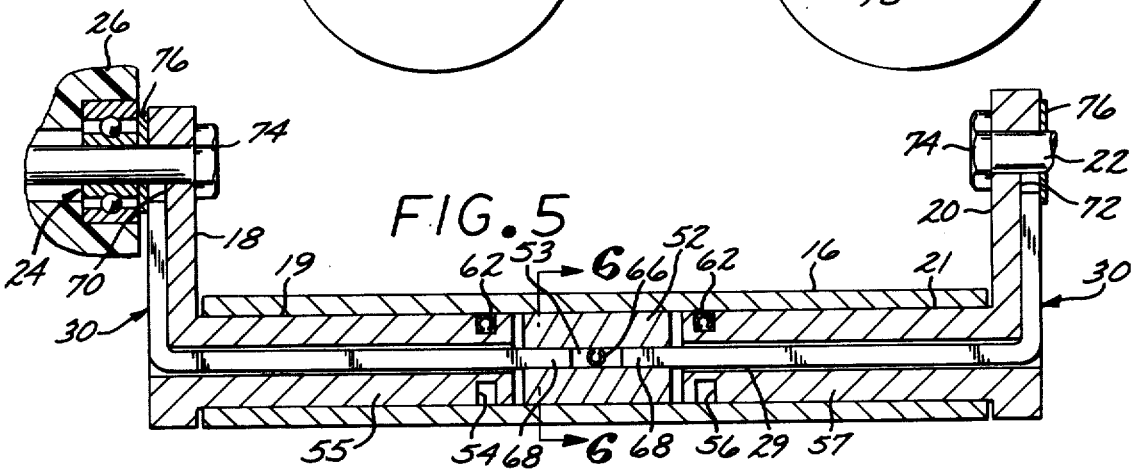

FIG. 6
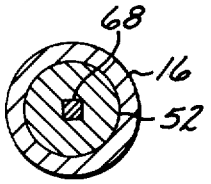
FIG. 7
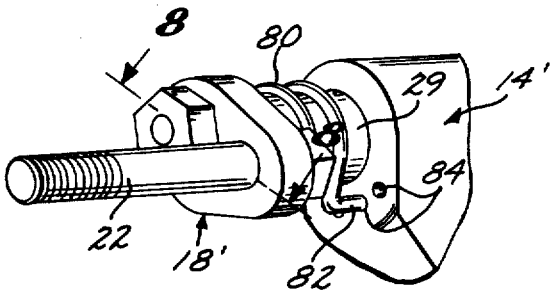
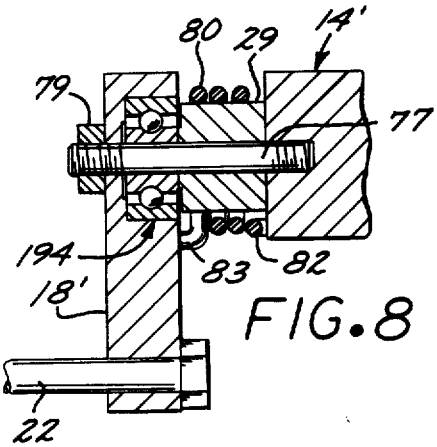
FIG. 8
FIG. 9
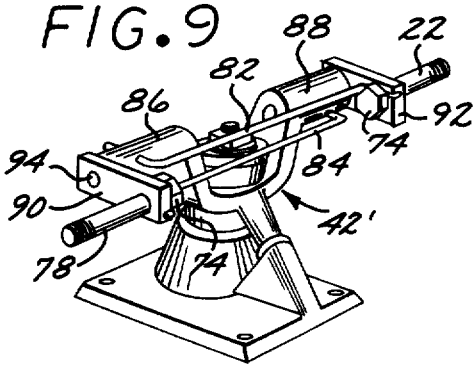
FIG. 10
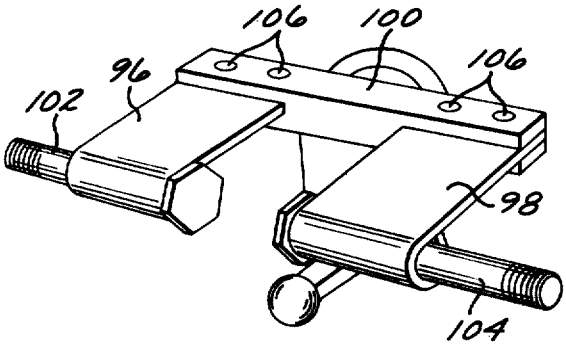
FIG. 11
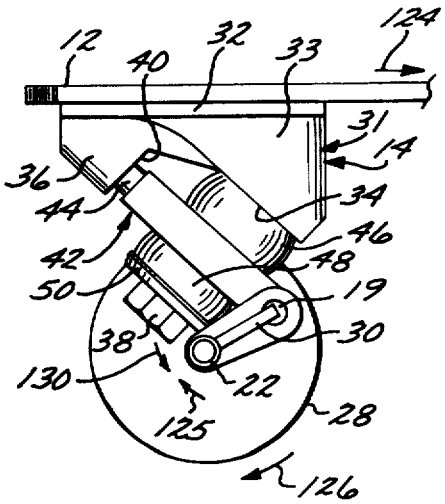

FIG.12
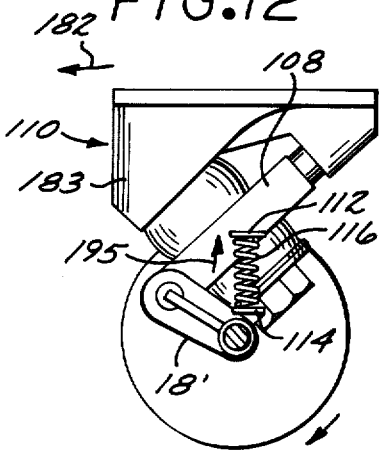
FIG.13
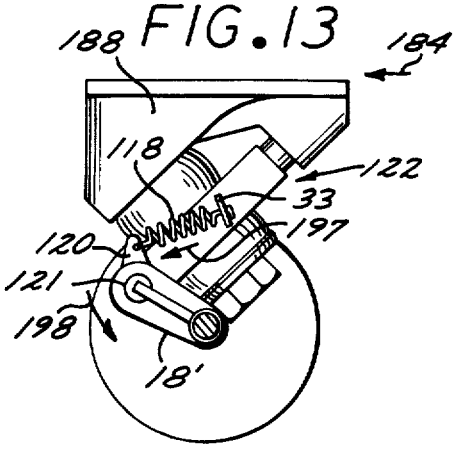
FIG.14
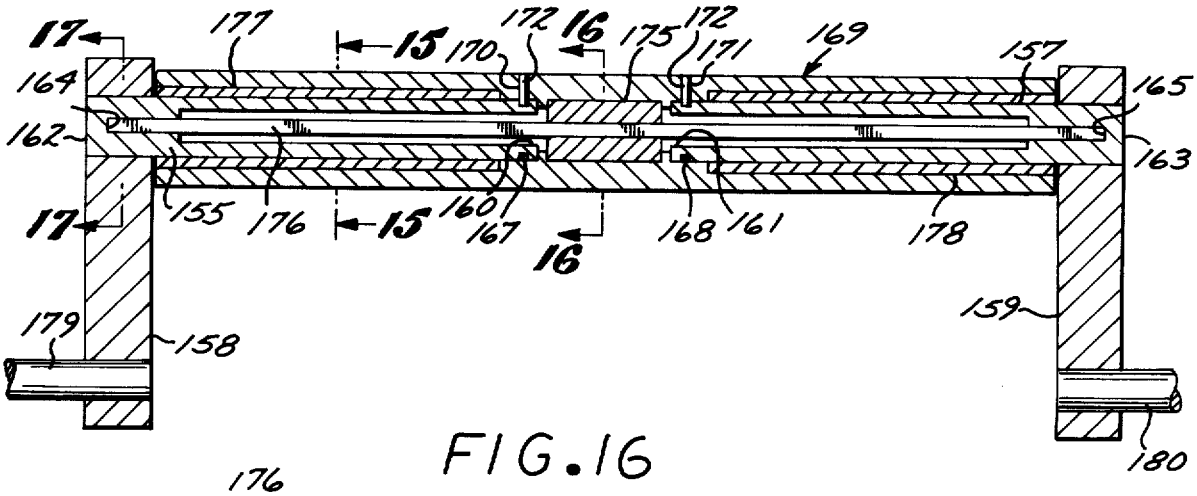
FIG.16
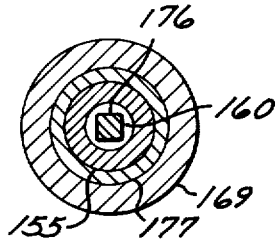
FIG.15
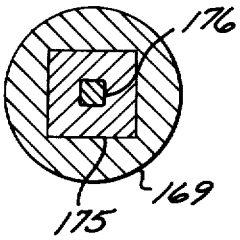
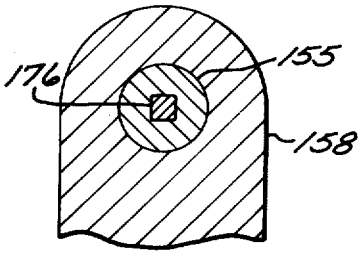
FIG.17

SKATEBOARD TRUCK WITH INDEPENDENT WHEEL SUSPENSION

FIELD OF THE INVENTION

The present invention relates to skateboard trucks and the mounting of skateboard wheels thereon.

DESCRIPTION OF THE PRIOR ART

In the past skateboards have been constructed with a pair of trucks located along the center line and on the underside of a longitudinally elongated platform, the upper surface of which is termed a deck. One truck is located near the forward end of the platform while the other truck is located remotely therefrom near the rear end of the platform. Each of the trucks carries a pair of skateboard wheels on axle segments extending laterally outward from either side of the platform center line in opposing directions in fixed disposition relative to each other. Each axle segment carries a single wheel, so that the skateboard is supported upon four wheels.

In conventional skateboards, the forward truck is attached to the underside of the skateboard platform by screws or other fasteners. The forward truck includes a downwardly extending post which entraps a yoke or other mounting structure between a pair of compressible resilient bearings. Frequently the yoke includes a longitudinally extending pivot pin, inclined upwardly and forwardly toward the underside of the platform and along the center line thereof. The forward extremity of this pivot pin is typically rotatably seated in a socket also mounted upon the truck. A single alxe or opposing axle segments extend laterally outward from either side of the yoke in fixed disposition thereto, and skateboard wheels are rotatably mounted thereon. A similar truck, with a pivot pin mounted in a direction 180° opposite the pivot pin of the front truck, is provided at the rear end of the skateboard with a rearwardly extending pivot pin.

The skateboard rider is able to propel himself along a reasonably smooth roadway or other rolling surface and to maneuver or steer the skateboard by shifting his weight laterally from side to side, and to perform stunts on the board by both longitudinally and laterally shifting his weight.

It is to be understood that the term roadway, as used in the description herein, is intended to refer broadly to any surface upon which a skateboard can be operated. Thus, this term is intended to include such surfaces as sidewalks, streets, drained swimming pools, the insides of concrete pipe, and numerous other surfaces upon which skateboards may be operated.

When the skateboard rider laterally shifts his weight on the skateboard the platform is tilted relative to the laterally extending axles or axle segments. Such tilting is possible because resilient bearings about the post of the truck are compressed to a considerable degree on one side of the skateboard, while pressure is relieved from these bearings on the opposite side. This results in an increased downward pressure on the skateboard wheels on the side of the board bearing the greatest weight. Consequently, the wheels on this side are resiliently flattened to a slight degree, thus creating a small drag on the forward rotation of the wheels on that side. At the same time, since pressure is relieved from the opposite side of the board, and because of the downward pressure on the side of the board to which weight is shifted, the axle orientation shifts from a horizontal disposition to an attitude in which the axle is inclined downwardly toward the roadway surface upon which the skateboard is propelled on the side of the skateboard to which the increased weight is applied and lifted at the opposite side. This tends to lift the wheels of the skateboard from the roadway surface on the side opposite that to which increased weight is shifted. When the skateboard is manipulated in this manner, the socket of the truck receiving the pivot pin tends to rotate relative to the pivot pin in the direction toward which weight is shifted. Movement of weight relative to the platform in this way effectuates a departure of movement of the skateboard from a straight line, and instead causes the skateboard to move in an arc about a point displaced laterally from the skateboard in the same direction toward which weight on the skateboard is shifted.

Certain deficiencies exist in the operation of conventional skateboards. For example, because the wheels of each truck are locked in coaxial alignment, tilting of the platform down on one side, while attempting to turn, tends to slightly raise the skateboard wheels off of the rolling surface at the opposite side. As a result, contact of the skateboard with the rolling surface is more concentrated at the wheels remaining in firm contact with the road surface. This decrease in the breadth of contact with the rolling surface results in a deterioration of control over the movement of the skateboard. Moreover, in this condition the skateboard is much more likely to slide laterally out of control should it strike a road hazard, such as a pebble or spot of oil, or especially when extreme turning radii are attempted to avoid roadway hazards such as minor chuckholes and other depressions or obstructions.

SUMMARY OF THE INVENTION

In contrast the unique structure of the wheel mounting arrangment offered by the present invention significantly increases the degree of control maintained by the skateboard rider, even while performing complex maneuvers. Because each wheel is mounted in independent suspension from the skateboard trucks, only under extreme circumstances will any of the wheels lose contact with the roadway. Consequently, because of the improved wheel contact on the roadway, the rider is able to maintain a much greater degree of control during maneuvers of the skateboard. This allows a rider to perform sharp turns and stunts which would be quite dangerous using a skateboard with conventional wheel mountings. Furthermore, because each wheel is able to accomodate independent motion of the skateboard platform relative thereto, the increase in surface contact of the wheels with the roadway does not result in a loss of maneuverability, as is the case with skateboards of conventional wheel mounting construction.

A further feature provided by the spring biased independent suspension of skateboards improved according to the invention is an increase in speed. When the rider pumps the skateboard to propel it forward, this tends to compress the springs or stree the torsion bar bias, thereby pushing the platform closer to the wheel. Between pumping steps, therefore, this stored energy is released as the springs of torsion bars tend to resume their former configuration. The energy dispelled when the wheels are released in an arrangement in which the wheels are rotatably mounted on swing arms aids in the forward propulsion of the skateboard.

A further feature provided by the independent spring biased arrangement is an inherently smoother ride while traveling over sidewalk cracks or minor bumps. Also the independent suspension prevents the rider from being ejected from the skateboard when encountering small unexpected rocks as is nearly always the case with conventional skateboard trucks.

Pursuant to the invention, a wide choice of different types of wheel mountings are available for selection without departing from the concept of the invention. In its simplest terms, the invention resides in the independent suspension of wheels on the underside of a skateboard. In contrast, in conventional skateboards, the axles or axle segments of the wheels of each truck remain in fixed alignment relative to each other. While it is conceivable that wheels could be mounted in independent suspension to move only in reciprocal or translational motion relative to the skateboard platform, a much more desirable arrangement results by mounting each wheel on a separate longitudinally aligned arm which is rotatably connected to a mounting on the truck. Furthermore, each wheel axle or mounting arm is spring biased to an orientation longitudinally displaced from the rotatable connection of the arm to the truck mounting. When supported in this fashion, the skateboard platform and each of the wheels undergo relative rotational motion, with the wheel axles moving separately in arcs centered about the connection of the lever arm to the truck mounting.

Independent spring biasing of each of the wheels may be achieved in any one of a number of different ways. The alternatives include leaf spring mountings, spiral or hair spring mountings, compression spring biasing, tension spring biasing, torsion bar or torsion rod suspension, pneumatic suspension, and suspension relative to a resiliently deformable cushion. Whichever mode of suspension is adopted, it is essential that the biasing device operate separately upon each of the wheels of the skateboard.

The invention may be explained with greater particularity and clarity by reference to the accompanying drawings.

DESCRIPTION OF THE DRAWINGS

FIG. 1 is a perspective view of a skateboard according to the invention.

FIG. 2 is an enlarged front elevational view of a portion of one embodiment of the invention.

FIG. 3 is a sectional side elevational view taken along the lines 3—3 of FIG. 2.

FIG. 4 is a sectional side elevational view taken along the lines 4—4 of FIG. 2.

FIG. 5 is a cross sectional view of the truck mounting taken along the lines 5—5 of FIG. 4.

FIG. 6 is a sectional view taken along the lines 6—6 of FIG. 5.

FIG. 7 illustrates in perspective an alternative wheel mounting embodiment according to the invention.

FIG. 8 is a sectional view taken along the lines 8—8 of FIG. 7.

FIG. 9 illustrates another alternative wheel mounting construction.

FIG. 10 illustrates in perspective yet another alternative embodiment of a leaf spring wheel mounting support.

FIG. 11 illustrates wheel movement at the rear truck according to the invention in the context of the embodiment of FIGS. 1-6.

FIG. 12 is a side elevational view of a wheel mounting using a compression spring biasing arrangement.

FIG. 13 is a side elevational view illustrating a wheel mounting using a tension spring biasing arrangement.

FIG. 14 is a cross sectional view of a truck mounting of an alternative embodiment of the invention similar to the view of FIG. 5.

FIG. 15 is a sectional view taken along the lines 15—15 of FIG. 14.

FIG. 16 is a sectional view taken along the lines 16—16 of FIG. 14.

FIG. 17 is a sectional view taken along the lines 17—17 of FIG. 14.

DESCRIPTION OF THE EMBODIMENTS

A skateboard 10 is depicted in FIG. 1 and includes a longitudinally elongated platform 12 which is constructed of relatively thin, uniform thickness throughout. The platform 12 is normally constructed of wood or fiberglass and is of a streamlined shape in which a narrow nose, or front extremity of the platform 12 widens rapidly to a maximum lateral dimension and narrows slightly toward the rear extremity. The top side or deck, of the platform 12, visible in FIG. 1 supports a skateboard rider standing thereon. To the underside of the platform 12 are attached a pair of trucks 14, one fore and one aft.

The trucks 14 are identical except that they are arranged in mirror disposition oriented 180° opposite each other on the underside of the deck 12. The front truck is depicted in FIG. 4 and is arranged to move in the direction indicated by the arrow 190, while the rear truck is illustrated in FIG. 11 for movement in the direction indicated by the arrow 124. To the ends of mounting barrel 16 a pair of longitudinally extending swing arms 18 and 20 are rotatably connected, as illustrated in FIG. 5 and in FIGS. 4 and 11. Cylindrical axles 22, directed laterally outward from the centerline of the skateboard 10, are rigidly secured to and extend from the longitudinally directed arms 18 and 20. Annular wheels 26 and 28 are mounted on either side of the trucks 14 upon the axles 22 using conventional interiorly disposed annular sealed bearings of the type depicted at 24. Each of the arms 18 and 20 in the embodiment of FIGS. 1-6 is resiliently biased relative to the underside of the platform 12 by means of L-shaped torsion bars 30 of square cross sectional configuration, as depicted in FIGS. 3 and 6.

As depicted in FIG. 11, each of the trucks 14 includes a support mounting base 31 that has a flat anchor plate 32 that resides in contact with the underside of the platform 12 and is fastened thereto by means of screws or other conventional fasteners. From one end of the anchor plate 32 a mounting bracket 33 projects downward and includes a downwardly inclined planar face 34, as most clearly illustrated in FIG. 11. A hole is drilled perpendicular to the inclined face 34 and is at least partially tapped to receive a mounting bolt 38, the head of which is visible in FIG. 11. At the other edge of the anchor plate 32 a socket hub 36 is defined to include a downwardly inclined planar face 40 into which a socket bore is drilled. Preferably, the anchor plate 32, the mounting bracket 33 and the socket hub 36 are all formed from a single integral cast aluminum or other suitable structural material such as plastic or nylon.

Each truck 14 also includes a yoke shaped housing 42, also integrally cast from aluminum or steel. The yoke 42 includes an upwardly and forwardly or rearwardly directed pivot pin 44 aligned along the centerline of the platform 12 and disposed to ride in the socket defined in the hub 36. At the lower extremity of the yoke shaped housing 42, an annular transversely extending mounting barrel 16 is formed to carry the wheels 26 and 28 at laterally separated locations on either side of the centerline of the platform 12. The yoke shaped housing 42 is therefore of a generally triangular configuration, the apexes of which are formed by the lateral extremities of the barrel 16 and the nose of the pivot pin 44. At roughly its center, the yoke 42 is drilled perpendicular to its generally planer orientation to receive the mounting bolt 38. Thick urethane or hard rubber cushions 46 and 48 are positioned on either side of the yoke 42 and are entrapped by the mounting bolt 38 and retaining washers 50 visible in FIG. 11. The mounting bolt 38 is threadably engaged in the tapped hole in the planer face 34 of the mounting bracket 33. This arrangement allows the platform 12 to be tilted from side to side relative to the lateral extremities of the barrel 16 by selectively compressing portions of the rubber cushions 46 and 48, as with conventional skateboards. This arrangement also allows variable tension to be placed on cushions 46 and 48 by adjusting bolt 38, thereby limiting the degree or magnitude of turning radius by a rider.

As previously noted, the yoke shaped housing 42 is an integral structure, and may be manufactured with a hardened steel tubular core so that the core is permanently and immovably entrapped within the barrel 16. In one embodiment, the core may be of a generally cylindrical configuration formed with longitudinally extending splines and press-fitted into place within the barrel. The core could be formed with a square or hexagonal axial passageway by broaching so as to accomodate the torsion bar.

In the embodiment depicted in FIG. 5, however, a smooth surfaced cylindrical tubular core 52 formed of hardened steel is removably located centrally within the confines of the barrel 16. In this embodiment, the tubular core 52 has an outer circular cross sectional configuration, but has defined therein an axial passageway of some geometrical cross sectional shape. For example, the axial passageway may be of hexagonal cross section so as to accomodate hardened steel allen wrenches which might serve as the torsion bars 30. Alternatively, the axial passageway can be formed in a square cross section to accomodate a corresponding hardened steel L-shaped torsion bar of square cross section.

At the center of the barrel 16 transverse apertures 64 are defined in the walls of the barrel 16 in diametrically opposite disposition relative to each other. A corresponding transverse diametrical passageway is defined in the core 52 to receive a solid hardened cylindrical pin 66 which intersects the center of the axial cavity in the barrel 16 between the interior extremities of the torsion bars 30, as depicted in FIG. 5. In this manner, the hardened steel core 52 is locked into position relative to the barrel 16, by the pin 66, which bears against the opposing walls of the barrel 16. The interior extremities 68 of the torsion bars 30 are received by the core 52 and anchored in fixed disposition therein within the barrel 16, as illustrated in FIG. 6.

In the embodiment of FIG. 5 stub axles 55 and 57 extend laterally and are interiorly directed toward the center of the barrel 16 within the confines thereof from the longitudinally extending arms 18 and 20 respectively. Circular grooves 54 and 56 are formed in the outer surfaces of the stub axles 55 and 57 respectively near their interior extremities. When the stub axles 55 and 57 are in proper longitudinal orientation relative to the barrel 16, the grooves 54 and 56 are longitudinally aligned respectively with chordal apertures 58 and 60, the appearances of which are visible in FIG. 2, which extend through the barrel 16 on either side of the core 52. Roll pins 62 may then be inserted into the apertures 58 and 60 to reside within the grooves 54 and 56 to longitudinally immobilize the stub axles 55 and 57 while still permitting rotation thereof. The apertures 58 and 60 are formed of a diameter small enough so that the longitudinal slot of the tubular roll pins 62 must be narrowed to allow insertion. Normally, the roll pins 62 are driven into place with a hammer and pin punch and may be removed in the same manner if necessary.

The lateral extremities of the L-shaped torsion bars 30 extend outward and curve to extend longitudinally downward at an angle in registration within slots 70 and 72 defined within the outer surfaces of the lever arms 18 and 20 respectively. At the free ends of the lever arms 18 and 20 remote from the rotatable disposition of the stub axles 55 and 57 within the barrel 16 of the mounting assembly, bolts 74 are provided and are directed laterally outward through the lever arms 18 and 20. The heads of the bolts 74 thus reside in contact with the interior surfaces of the lever arms 18 and 20 and the bolt shanks extend from the exterior surfaces thereof to serve as the wheel axles 22. On the exterior surfaces of the arms 18 and 20, washers 76 are provided and have an outer diameter sufficient to overlap the extremities of the L-shaped torsion bars 30. The washers 76, which are pressed against the exterior surfaces of the lever arms 18 and 20, thereby entrap the torsion bars 30 within the slots 70 and 72 of the lever arms 18 and 20 respectively.

An alternative torsion bar suspension system is illustrated in FIGS. 14–17. In this embodiment the stub axles 155 and 157 are not integrally formed with the swing arms 158 and 159. Rather, the stub axles 155 and 157 are constructed in the form of cylinders closed at one end and open at the other with longitudinally extending bores 160 and 161 therein reaching almost to the blind ends indicated at 162 and 163. At the blind ends 162 and 163 of the stub axles 155 and 157, depressions 164 and 165 of smaller cross section and of shorter length than the bores 160 and 161 are defined. The depressions 164 and 165 are preferably of square cross section and are formed by broaching to receive the ends of the torsion bar 176 as illustrated in FIGS. 15 and 17. The blind ends 162 and 163 of the stub axles 155 and 157 are pressed and furnace brazed into place into apertures in the swing arms 158 and 159. Annular grooves 167 and 168 are defined in the outer surfaces of the stub axles 155 and 157 remote from the blind ends 162 and 163.

The barrel 169 of FIG. 14 has a cylindrical outer surface, but with deep slots 170 and 171 formed therein at intermediate locations. The slots 170 and 171 receive C-shaped clip retainers 172 inserted into the slots 170 and 171 and fastened about the stub axles 155 and 157 at the grooves 167 and 168 therein. The retainers 172 are retained within the slots 170 and 171 and bear against adjacent transverse surfaces of barrel 169 to longitudinally immobilize the stub axles 155 and 157 and hence the wheels of the skateboard relative to the barrel 169.

In the formation of the barrel 169, liquid aluminum or other material is cast in a mold about a hardened steel insert 175. The insert 175 is positioned between the slots 170 and 171 and is held in place by internally formed shoulders 199 of the barrel 169. The insert 175 is preferably of square outer cross sectional configuration and includes a square aperture therethrough of the same cross sectional dimensions as the depressions 164 and 165, as illustrated in FIG. 16. The insert 175 serves as an anchoring device for the elongated torsion bar 176, which fits snugly within the square aperture in the insert 175, as illustrated in FIG. 16. The ends of the torsion bar 176 extend into the depressions 164 and 165, where they are similarly received in a close fitting arrangement, as in FIG. 17. The torsion bar 176 is preferably a single elongated member formed of heat treated chromalloy. The structure of the barrel 169 is completed by sleeve-like bushings 177 and 178 of oilite cast or forced into place at the ends of the barrel 169 to receive the stub axles 155 and 157. Cylindrical axles 179 and 180 are pressed and furnace brazed into place at the remote free ends of the swing arms 158 and 159.

Since the torsion bar 176 is anchored at the center of the barrel 169, it interacts with each of the stub axles 155 and 157 independently of the other. The axles 179 and 180 with wheels mounted thereon at the ends of the swing arms 158 and 159 are thereby carried in independent suspension from the skateboard trucks 14 as in the embodiment of FIGS. 1–6 and 11.

Various alternative spring biasing and wheel mounting arrangements are also possible. For example, FIG. 7 illustrates an embodiment of the invention in which a swing arm 18' is mounted relative to a truck 14' in any one of the several possible arrangements explained in conjunction with the embodiment of FIGS. 1–6. However, rather than employing an L-shaped torsion bar 30, the bolt shank forming the wheel axle 22 is spring biased in rotation about the stub axle 29 by means of a spiral hair spring 80. The hair spring 80 extends in a helical configuration about the stub axle 29 of the swing arm 18' as illustrated in FIGS. 7 and 8. The ends of the hair spring 80 are turned in opposite directions to extend laterally, the end 82 residing in a lateral aperture in the truck 14, while the opposite end 83 is directed laterally outward into a similar aperture in the swing arm 18'. It should be noted in this connection that a choice of two apertures 84 are provided in the truck 14'. The selection of the particular aperture 84 into which the interiorly laterally directed end 82 of the coil spring 80 is inserted determines the rotational biasing force applied to the swing arm 18'. A retaining nut 79 holds the swing arm 18' longitudinally immobilized and is threadably engaged on the end of the stub axle 29. A bearing 194 is used to carry the arm 18' in smooth movement.

As is the case in all of the embodiments of the invention, the greater the force applied to the biasing means, the better the skateboard wheels will hold to the ground. By the same token it must be considered that the greater the biasing force applied, the greater must be the weight differential in order to effectuate a particular maneuver of the skateboard. Accordingly, the degree of spring biased is preferably suited to the weight of the intended rider. In addition to the spring bias initially applied, the spring configuration also affects the stiffness of the ride. That is, springs of larger cross section will commensurately stiffen the ride as contrasted with springs of smaller cross section. Conversely, springs of a greater length reduce the ride stiffness as contrasted with shorter springs.

Yet another embodiment of the invention is depicted in FIG. 9 in which externally mounted torsion bars 82 and 84 provide spring bias to the wheel mounts. In the embodiment of FIG. 9, the configuration of the yoke 42' differs from that of the yoke 42 in that the yoke 42' includes a pair of opposing laterally directed sleeves 86 and 88 in place of the single mounting barrel 16. The swing arms 90 and 92 are substantially similar in operation to the swing arm 18' of FIG. 7 with minor exceptions. Specifically, the swing arms 90 and 92 are of rectilinear configuration, rather than of the rounded configuration of the swing arm 18'. Also, ends of the stub axles 94 are press fitted into apertures in the swing arms 90 and 92.

The opposing ends of each of the torsion bars 82 and 84 in the embodiment of FIG. 9 are secured to one of the swing arms 90 and 92 and to a remote one of the sleeves 86 and 88. Specifically, the torsion bar 84 is directed through a chordal aperture in the sleeve 88 and serves to both longitudinally immobilize the stub axle 94 therein, and also to anchor the torsion bar 84 to the sleeve 88. The opposite end of the torsion bar 84 is entrapped beneath the bolt head 74, thereby securing the laterally extending end of the torsion bar 84 to spring bias the swing arm 90 to a given disposition. Similarly, one end of the torsion bar 84 is directed through a chordal aperture in the sleeve 86 to retain the other stub axle 94 in fixed disposition therein. The opposite end of the torsion bar 82 is secured beneath the head of the bolt 74 from which the wheel axle 22 extends. The truck 14' operates in much the same manner as does the truck 14.

Yet an additional embodiment of the invention is depicted in FIG. 10 in which the independent spring biasing to each of the wheels is provided by means of a separate one of the leaf spring arms 96 and 98. The leaf spring arms 96 and 98 are disposed with corresponding ends in registration in laterally extending leaf spring arm slots in a mounting bar 100, and are secured therein by rivets 106. The mounting bar 100 performs the function of and corresponds to the barrel 16 of the embodiment of FIGS. 1–5, the body of the truck 14' of FIGS. 7–8, and the sleeves 86 and 88 of the embodiment of FIG. 9. By being of relatively great breadth across, the leaf springs 96 and 98 are able to avoid a twisting effect, and hence hold the axles 102 and 104 upon which the skateboard wheels are mounted in a constant attitude relative to the mounting bar 100. The wheel axles 102 and 104 are formed by conventional bolts threaded at the ends as indicated, or they may be rods press-fitted into encircling rolled spring arm eyes at the extremities of the left springs 96 and 98 to provide firm wheel connections. It should be noted, that with this embodiment, as in the other embodiments of the invention, each of the wheels is mounted in independent spring suspension. that is, the leaf springs 96 and 98 are flexed during use independently of each other. In place of the rivets 106, the leaf springs 96 and 98 could be anchored to the mounting bar 100 by bolts extending through the mounting bar 100.

Still another embodiment of the invention is depicted in FIG. 12, which illustrates a mounting yoke 108 of a rear truck 110 having a base 183 and oriented for travel in the direction indicated by the horizontal arrow 182. The yoke 108 has laterally extending anchoring tabs 112 on either side thereof. A swing arm 18' is provided as in the embodiment of FIG. 7, with the addition of a forwardly and horizontally projecting ear 114. In place of the torsion bar of the embodiment of FIGS. 1–6, or the hair spring 80 of FIG. 7, a compression spring 116 is provided and has ends secured to the anchoring tabs 112 and to the projecting ears 114. An increase in weight on the platform 12 will cause the compression spring 116 to contract and will cause relative motion between the platform 12 and the wheel 28, as indicated by the arrow 195. A decrease in weight on the platform 12 will cause the coil spring 116 to become elongated.

The truck 122 in FIG. 13 is a rear truck with a base 188 mounted upon a skateboard for travel in the direction indicated by the arrow 184. In contrast to the truck 110 of FIG. 12, the truck 122 in the embodiment of FIG. 13 is provided with a pair of tension springs 118, each of which includes one end secured through an aperture in the mounting brackets 33 extending laterally from opposite sides of the yoke 185. Opposite ends of the tension springs 118 pass through apertures in the opposing crank levers 120. The crank levers 120 are press-fitted onto stub axle shafts 121, as are the swing arms 18'. Each of the swing arms 18' and the associated crank lever 120 thereby move together in rotation as a bell crank in the direction of the arrow 198 relative to the truck 122 to extend the associated tension spring 118 in the direction indicated by the arrow 197 when weight is applied to the platform 12. The spring biasing feature of the independent wheel suspension allows each tension spring 118 to contract independently when weight is withdrawn.

The motion of the skateboard wheels according to the invention may be explained with reference to FIG. 11, which depicts a rear skateboard wheel. When the skateboard 10 is in motion in the direction indicated by the arrow 124, the truck 14 maintains the rear wheels of the skateboard in trailing disposition and the front wheels in leading disposition. That is, the arm 20 of the rear truck is rearwardly directed in a longitudinal orientation so that the wheel 28 rotates in the direction indicated by the arrow 126 about the axle 22 which is located to the rear of the rotatable connection of the arm 18 with the yoke 42. The arm 18 is thus directed longitudinally rearward. As used herein, a longitudinal disposition refers to an orientation directed in a plane parallel to the center line of the skateboard 10. A vertically upward or downward component of orientation may also be associated with a longitudinal disposition of a member, but in any event, that member lies in a vertical plane parallel to a plane passing through the center of the skateboard 10.

As the skateboard 10 travels in the direction indicated by the arrow 124, the wheels rotate in the direction indicated by the arrow 126. As the weight on the wheel 28 increases, the platform 12 is pressed lower toward the wheel 28 in the vicinity thereof, so that arm 18 undergoes relative rotational movement toward the platform 12 in the direction indicated by the arrow 125, thereby increasing the return force applied to the axle 22 by the torsion bar 30. This force tends to return the wheel 28 to its original disposition relative to the platform 12. Conversely, a lightening of the load on the wheel 28 will allow the platform 12 to rise adjacent thereto, thereby causing relative rotation in the direction indicated by the arrow 130 in FIG. 11, as between the swing arm 18 and the yoke 42. This reduces the torsional force applied by the torsion bar 30, and allows the wheel 28 to remain in contact with the roadway surface despite significant decreases in load applied to the wheel 28.

The action of the wheels under the influence of the torsion bar 30, or other spring biasing mechanism, provides a shock absorbing quality to the ride and dampens sudden jolts. In banking the skateboard 10, such as occurs in following the lateral contour of the perimeter of a drained swimming pool floor, the independently supported wheels remain in contact with the roadway surface. The lower wheel tends to move downward relative to the platform 12 to follow the road surface and remain in contact therewith despite the decrease in force applied to the lower wheel. Thus, contrary to conventional skateboards, both wheels remain in contact with the roadway surface. In turning, this feature provides a much wider, more stable arrangement than with conventional trucks. Because of this increased stability, much sharper turns and more difficult maneuvers are possible using the invention, since the degree of rider control over the skateboard does not deteriorate to nearly the extent that it does with conventional skateboards.

It is to be understood that numerous different embodiments of the invention may be provided without departing from the fundamental scope thereof. For example, while rearwardly longitudinally directed swing arms are envisioned for use with the invention, in some instances forwardly directed swing arms may be more desirable. Also, it should be recognized that the proper degree of biasing force applied to the independently suspended wheels will vary according to the weight of the rider. That is, the desired biasing force will be considerably less with skateboards intended for use by small children of lighter weight as contrasted with skateboards intended for use by heavier youths, such as teenagers. Accordingly, the particular structural arrangements of the embodiments depicted should not be considered as limiting the scope of the invention, which instead is defined in the claims appended hereto.

I claim:

1. A skateboard truck in which a plurality of wheels are mounted for rotation about axles extending laterally outwardly from a mounting, the improvement wherein said wheels are carried in independent suspension from said mounting and comprising separate longitudinally extending swing arms associated with each axle connected to said mounting and to the axle associated therewith, with each of said axles being resiliently biased toward a position longitudinally displaced from the interconnection of the associated swing arm with said mounting, said swing arms being rotatably connected to said mounting, an elongated torsion bar section being associated with each axle, and each section being rigidly secured at one end to said mounting with the other end secured to the swing arm associated therewith.

2. A skateboard truck according to claim 1 wherein each of said torsion bars includes a laterally extending portion and a longitudinally extending portion.

3. A skateboard truck in which a plurality of wheels are mounted for rotation about axles extending laterally outwardly from a mounting, the improvement wherein said wheels are carried in independent suspension from said mounting and comprising separate longitudinally extending swing arms associated with each axle connected to said mounting and to the axle associated therewith, each of said swing arms being resiliently biased toward a position longitudinally displaced from the interconnection of the associated swing arm with said mounting, said swing arms being rotatably connected to said mounting and a separate laterally aligned coil spring is secured at one end to said mounting and at an opposite end to a swing arm associated therewith at a connection transversely displaced relative to the connection of said swing arm to said mounting.

4. A skateboard truck in which a plurality of wheels are mounted for rotation about axles extending laterally outwardly from a mounting, the improvement wherein said wheels are carried in independent suspension from said mounting and comprising separate longitudinally extending swing arms associated with each axle connected to said mounting and to the axle associated therewith, means for resiliently biasing each of said axles toward a position longitudinally displaced from the interconnection of the associated swing arm with said mounting, said swing arms being rotatably connected to said mounting, said mounting including pivot means for carrying the wheel axis for pivotal movement about an axis inclined in a plane extending longitudinally through the truck for steering action.

5. A skateboard comprising a longitudinally elongate platform, a pair of trucks fastened to the underside of said platform in relatively forward and rearward disposition, each truck including a mounting to which a plurality of longitudinally extending resiliently biased independently operated arms are connected, at least one laterally disposed axle extends from each arm at the ends thereof remote from said mountings, wheels are carried by said trucks and are rotatably secured on said axles, said mounting including pivot means for carrying the arms and wheel axles for pivotal movement about an axis inclined in a plane extending longitudinally through the truck for steering action.

6. A skateboard according to claim 5 wherein at least some of said arms are directed longitudinally forward.

7. A skateboard according to claim 5 wherein at least some of said arms are directed longitudinally rearward.

8. A skateboad according to claim 5 wherein said trucks each include a base and a yoke pivotally connected thereto and spring tension biasing means are operatively interposed between said yoke on opposite sides thereof, and said arms at connections displaced from the connections of said arms to said mountings.

9. A skateboard according to claim 5 further comprising an elongated torsion bar which is anchored at its midsection to said mounting and the ends of the torsion bar extend on either side to resiliently bias said arms at the connections thereof with said mounting.

10. A skateboard comprising a longitudinally elongate platform, a pair of trucks fastened to the underside of said platform in relatively forward and rearward disposition, each truck including a mounting with a base and a yoke pivotally connected thereto, a plurality of longitudinally extending resiliently biased independently operated arms connected to the yoke, at least one laterally disposed axle extending from each arm at the ends thereof remote from said yoke, wheels carried by said trucks and rotatably secured on said axles, and compression spring biasing means operatively interposed between said yoke on opposite sides thereof and said arms at connections displaced from said mountings to bias said wheels away from said platform.

11. A skateboard comprising a longitudinally elongate plateform, a pair of trucks fastened to the underside of said platform in relatively forward and rearward disposition, each truck including a mounting to which a plurality of longitudinally extending resiliently biased independently operated arms are connected, each truck including a laterally extending, out-of-round elongated torsion bar which is anchored at its midsection to said mounting and with the distal ends of said arms fixedly attached to and extending at right angles to respective ends of the torsion bar whereby the torsion bar resiliently controls pivotal movement of the arm about the longitudinal axis of the torsion bar, at least one laterally disposed axle extending from each arm at the ends thereof remote from said mountings, and wheels carried by said trucks and rotatably secured on said axles.

* * * * *